US005448960A

United States Patent [19]

Navlyt et al.

[11] Patent Number: 5,448,960

[45] Date of Patent: Sep. 12, 1995

[54] BINDING TAPE AND ELASTIC INSERTION

[75] Inventors: David M. Navlyt, Rock Hill, S.C.; Gregg A. Gibson, Gastonia, N.C.; Maximilian Adamski, Jr., Tega Cay, S.C.

[73] Assignee: Union Special Corporation, Huntley, Ill.

[21] Appl. No.: 130,647

[22] Filed: Oct. 1, 1993

[51] Int. Cl.[6] ..... D05B 35/06; D05B 19/00

[52] U.S. Cl. ..... 112/475.03; 112/130; 112/147; 112/152; 112/419; 112/475.06; 112/475.09; 112/470.32

[58] Field of Search ..... 112/121.26, 121.27, 112/147, 152, 305, 318, 322, 130, 265.1, 262.1, 262.2, 262.3, 121.11, 418, 419, 413, 417

[56] References Cited

U.S. PATENT DOCUMENTS

| | | | |
|---|---|---|---|
| 570,036 | 10/1896 | Merrick . | |
| 570,037 | 10/1896 | Merrick . | |
| 1,827,596 | 10/1931 | Maier . | |
| 3,182,619 | 5/1965 | Sally . | |
| 3,198,151 | 8/1965 | Micale | 112/152 |
| 3,664,284 | 5/1972 | Hester | 112/152 |
| 3,750,603 | 8/1973 | Martin | 112/121.11 X |
| 3,792,672 | 2/1974 | Friedman et al. | 112/104 |
| 4,044,698 | 8/1977 | Conner, Jr. | 112/121.12 |
| 4,075,956 | 2/1978 | Manetti | 112/121.27 |
| 4,143,604 | 3/1979 | O'Keefe | 112/152 |
| 4,335,666 | 6/1982 | Schwaab et al. . | |
| 4,777,891 | 10/1988 | Hyca | 112/130 |
| 4,829,919 | 5/1989 | Fieschi | 112/152 |
| 4,892,047 | 1/1990 | Fieschi | 112/122 |
| 4,895,088 | 1/1990 | Pirello | 112/130 |
| 4,903,622 | 2/1990 | Frey et al. | 112/152 |
| 4,913,071 | 4/1990 | Kawasaki | 112/152 |
| 4,922,843 | 5/1990 | Hyca | 112/318 |
| 5,123,369 | 6/1992 | Gross . | |
| 5,222,989 | 6/1993 | Hyca | 112/121.27 |
| 5,249,539 | 10/1993 | Hyca | 112/121.27 |
| 5,269,257 | 12/1993 | Yamazaki | 112/121.26 X |

FOREIGN PATENT DOCUMENTS

| | | | |
|---|---|---|---|
| 474322 | of 0000 | Germany . | |
| 3823946C2 | of 0000 | Germany . | |
| 4116297.8 | of 0000 | Germany . | |
| 8811711 U | of 0000 | Germany . | |
| 2250301 | 6/1992 | United Kingdom | 112/121.27 |

OTHER PUBLICATIONS

Pegasus publicating Binding tape and inserting elastic, W542-02SBx240/AT/MG/PL/EF.

*Primary Examiner*—Peter Nerbun

*Attorney, Agent, or Firm*—Willian Brinks Hofer Gilson & Lione

[57] ABSTRACT

A method and device that provides the operator with an unrestricted view of the stitch forming area of a sewing machine when binding a fabric edge and applying an elastic tape within the bound edge. The elastic tape is secured to the undersurface of the garment where it cannot become exposed or visible on the outside of the garment.

33 Claims, 9 Drawing Sheets

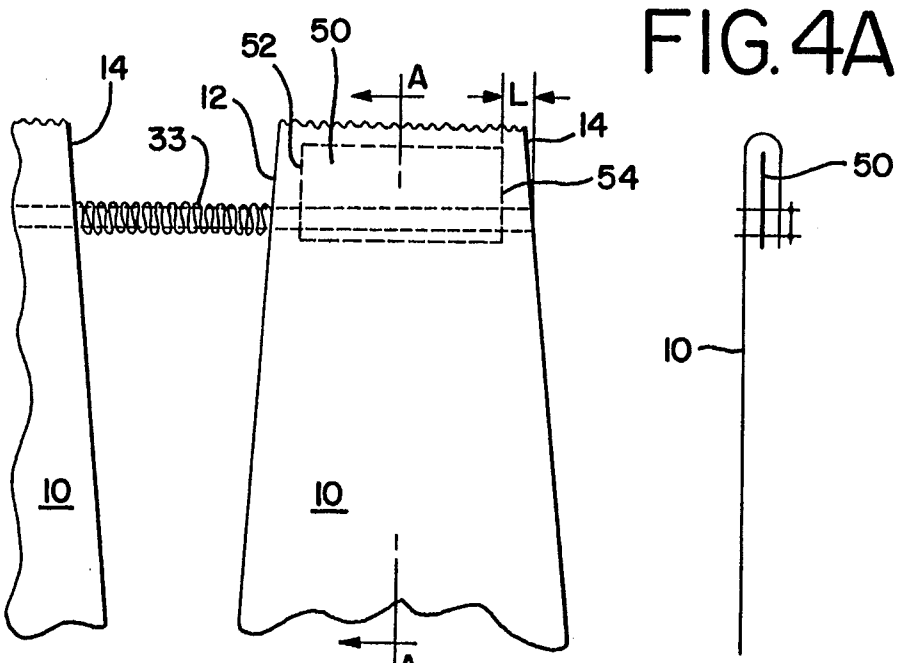
FIG. 4A
FIG. 4
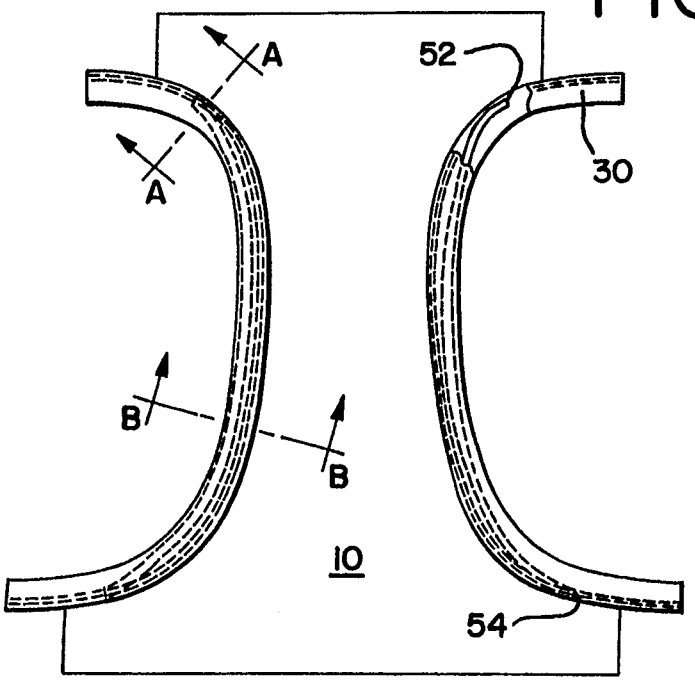
FIG. 3
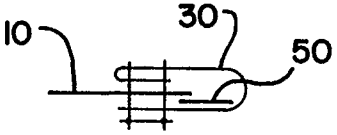
FIG. 3B
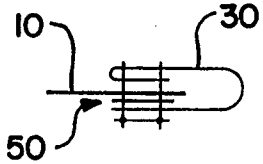
FIG. 3A

BINDING TAPE AND ELASTIC INSERTION

BACKGROUND OF THE INVENTION

Attaching binder material tape and inserting elastic tape in the leg openings of women's panties and men's underbriefs is a well known garment assemble method and there are various sewing systems to accomplish these operations. As seen in PRIOR ART FIG. 1 and 1A excess lengths of binder material tape and elastic tape overhang or extend past the leading and trailing edges of the garment fabric. In most situations this extra material is wasted and is cut off in the next sewing operation called "closing the side seams". The elastic tape is expensive and since there are four ends on each garment, the cost of this waste is high. This high cost of waste per garment is multiplied greatly since an operator can produce thousands of garments per day.

Furthermore, when the elastic tape extends across the side seam, it produces an uncomfortable and bulky seam which can result in sewing and trim knife problems in later sewing operations. This could result in down time for corrections and repairs of the sewing machine.

Other garment assembly applications, for example when applying elastic tape to the body openings in sweat pants, also waste excess lengths of elastic tape. When assembling the foot opening for a pair of sweat pants there are elastic tape overhangs extending past the leading and trailing edges of the garment fabric. These overhangs are usually cut off and wasted. Since the elastic tape used in sweat pants is quite wide this wasted material is very costly. The side seaming problem is also present in the sweat pants assembly operation.

In these prior art garment assembly methods the elastic tape is fed to the top surface (the outside of the garment) of the garment fabric. The elastic tape feeder that feeds the tape to the top surface of the garment is located between the operator and the stitch forming area and is an obstruction to the operators view. As a result this is a difficult and tedious operation for the operator. In performing this operation if the elastic tape drifts slightly to the left an edge of the elastic tape can become exposed. Since the tape has been applied to the outer surface of the garment the exposed edge is visible and distracts from the garment's appearance.

Applicants' have invented a method and device that produces a superior garment that does not have these problems. Rather than inserting the elastic tape at the beginning of the sewing operation applicants delay the insertion of the elastic tape for a preset distance such that the leading edge of the elastic tape trails the leading edge of the garment being stitched. The elastic tape feeder is located below the sewing machine work surface which does not obscure the operator's view of the stitch forming area and feeds the elastic tape to the underside of the garment (the inside of the garment).

When creating a bound edge, the edge of the elastic tape can become slightly exposed which adversely affects the appearance and acceptability of the garment. By applying the elastic tape to the inside of the garment, a slightly exposed edge of the elastic tape is not visible when the garment is being worn and thus the garment is more attractive and appealing to the customer.

When using applicants' new method and device the binding and elastic tape continues as usual along the edge of the garment being bound and the elastic tape is then cut short at a predetermined point such that the trailing edge of the elastic tape leads the trailing edge of the garment being stitched. As a result of using applicants' new method and device, not only is the high waste cost greatly reduced, a superior garment is produced. Since the operators view of the stitch forming area has been improved and is now unobstructed, generally speaking the quality of the work product is improved. Furthermore, the operator will experience less fatigue and the quality of work will be maintained. Still further the resulting garment is more attractive and will have a more comfortable, and less bulky closing seam.

Pegasus Sewing Machine Manufacturing Company, LTD, has exhibited a sewing machine that attaches the leading edge of the binder tape to the leading edge of the garment without inserting elastic tape at the start of sewing. An elastic tape is fed to the top surface of the garment (the outside of the garment) slid into the binding tap and its leading edge is tacked to the garment. The trailing edge of the elastic tape is also tacked to the garment before the end of the sewing and elastic tape is not inserted to the end of the sewing. The operators view of the stitch forming area is obscured by the elastic tape feeder and if the tape drifts slightly to the left its edge will be visible on the outside surface of the garment.

For the foregoing reasons, there is a need for a method and device that can be used to produce garments of superior quality in which the edge of the elastic tape will not be visible on the outer surface of the garment.

SUMMARY OF THE INVENTION

The present invention is directed to an improved method and device which enables an operator to have an unrestricted view of the stitch forming area of a sewing machine to produce a superior quality garment having a bound edge in which the elastic tape is secured to the undersurface of the garment where it cannot become exposed or visible on the outside of the garment and thus satisfies a need of the prior art.

The method includes the steps of loading the leading edge of an elastic tape into a material folder adjacent the leading edges of the garment. If the sewing operation is one that utilizes a binder material tape then the binder material tape is preloaded in the material folder. The garment and binder material tape, if used, are advanced to a location under the presser foot of the sewing machine. The stitching operation is started and the leading edge of the garment is sensed. A cutter is actuated, commencing a predetermined stitch count after the leading edge of the garment is sensed, which severs the garment being stitched from the preceding stitched garment. Also at a predetermined stitch count after the leading edge of the garment is sensed, the elastic tape is fed by the elastic tape feeder to the bottom surface of the garment toward the presser foot and is stitched to the garment within the bound edge of the garment. The trailing edge of the garment is sensed, and after a predetermined stitch count an elastic tape cutter is actuated which severs the elastic tape at a point that the severed trailing edge of the elastic tape will be stitched to the garment before the trailing edge of the garment is reached.

Applicants' elastic tape feeder, begins and ends the cycle, aligned with the sewing machine needles. The elastic tape feeder remains in this position, throughout the cycle, or can be shifted laterally such that the tape being fed will not be stitched by the needles. Thus, garments can be produced in which the elastic thread is stitched to the garment throughout its length or only at its opposite ends.

Also the feed rate of applicants' elastic tape feeder can be synchronized with the sewing speed and thus the tension on the elastic tape in the finished garment can be varied.

The sensors, cutters and stepper motor of applicants' device are connected to the micro-processor of the sewing machine control system.

BRIEF DESCRIPTION OF THE DRAWINGS

FIG. 3 is a top view of a piece of fabric that is being assembled into a garment in accordance with another version of applicants' invention.

FIG. 3A is a cross section view taken along lines A—A of FIG. 3.

FIG. 3B is a cross section view taken along lines B—B of FIG. 3.

FIG. 4 is a top view of a piece of fabric that is being assembled into a garment in accordance with another version of applicants' invention.

FIG. 4A is a cross section view taken along lines A—A of FIG. 4.

DETAILED DESCRIPTION OF THE PREFERRED EMBODIMENT

Figure 1:
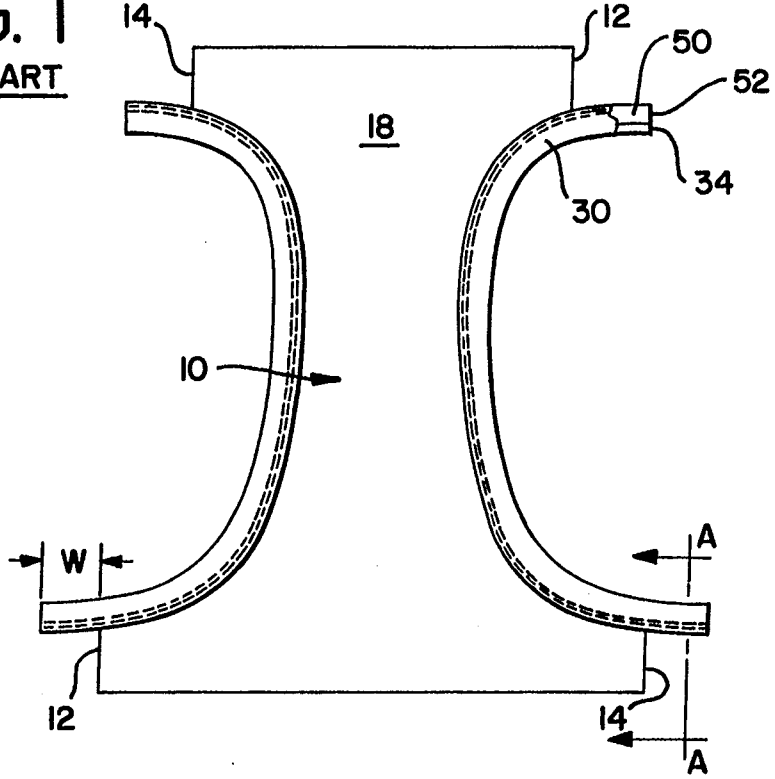
FIG. 1 PRIOR ART
FIG. 1 is a top view of a piece of fabric that is being assembled into a garment, in accordance with prior art methods and devices, that will have leg openings.
Figure 1A:
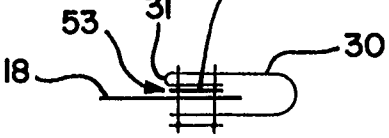
FIG. 1A PRIOR ART
FIG. 1A is a cross section view taken along lines A—A of FIG. 1.

FIGS. 1 and 1A are illustrations of a prior art method of attaching binder material tape and elastic tape to the leg openings of women's panties and men's underbriefs. The piece of fabric 10 for forming the garment has an arcuate shaped cutout formed in each side. This arcuate shaped cutout starts from the leading edge 12 and concludes at the trailing edge 14. Thus the leading edge 12 and trailing edge 14 are essentially parallel to each other as the piece of fabric 10 lies flat as seen in FIG. 1. The outside surface 18 of fabric 10 is visible in FIG. 1. A folded binder tape 30 enclosing an elastic tape 50 is stitched to the fabric 10 around each arcuate shaped leg hole cutout. When commencing this sewing operation the continuous binder tape 30 and continuous elastic tape 50 are in place in the binder tape folder. The binder tape folder forms the binder tape and positions the elastic tape into the shape and relative positions as seen in FIG. 1A. The sewing machine operator positions the piece of fabric 10 in the binder tape folder such that the binder tape 30 will cover both surfaces of the arcuate shaped leg hole cutout. When the sewing operation begins a length of binder tape 30 and elastic tape 50 are stitched together before the leading edge 12 of fabric 10 reaches the stitch forming area. After reaching the leading edge 12 the binding tape 30 and elastic tape 50 are stitched to the fabric 10 around one of the arcuate shaped leg openings and when the trailing edge 14 of the fabric 10 is reached stitching continues in the binder tape 30 and elastic tape 50. The operator positions another piece of fabric 10 in the binder tape folder. The piece of stitched binder tape 30 and elastic tape 50 that connects consecutive pieces is severed at its midpoint leaving a length W at each leading and trailing edge of the fabric 10. During the next sewing operation, called "closing the side seams", the four sections W are cut off and discarded. Thus, there are four pieces of binding tape and elastic tape, that are wasted for each garment produced. This elastic tape is expensive and thus this procedure has a substantial waste cost penalty.

As can be best seen in FIG. 1A the elastic tape 50 rests on the outside surface 18 of fabric 10. Ideally edge 53 of elastic tape 50 is concealed under the folded edge 31 of binder tape 30. However if elastic tape 50 drifts slightly to the left, edge 53 becomes exposed and spoils the appearance of the garment.

Figure 2:
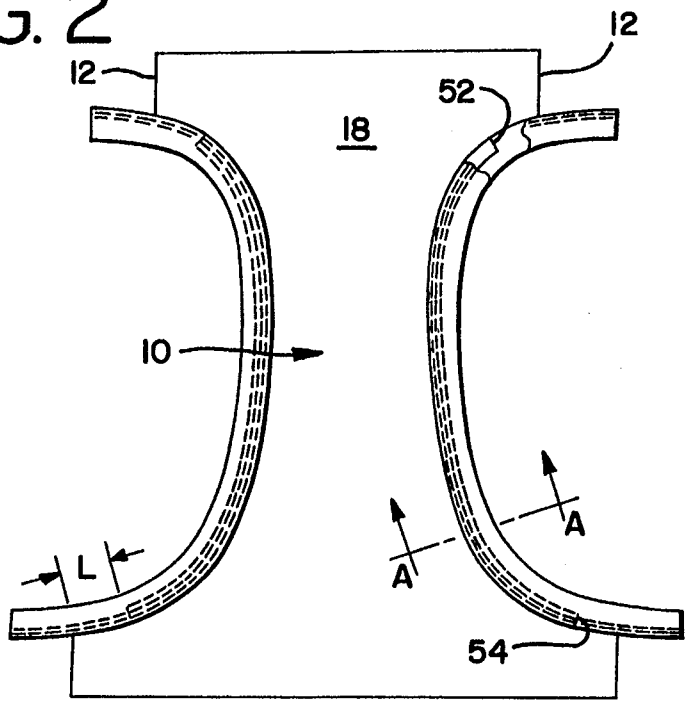
FIG. 2 is a top view of a piece of fabric, similar to FIG. 1, that is being assembled into a garment in accordance with a version of applicants' device.
Figure 2A:
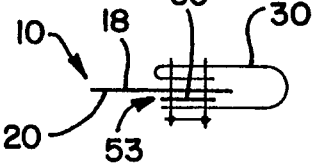
FIG. 2A is a cross section view taken along lines A—A of FIG. 2.

FIGS. 2 and 2A illustrate a version of applicants' invention used in constructing a garment such as a pair of women's panties or men's underbriefs. In this version of applicants' invention the elastic tape 50 is fed to the underside of the garment and its leading edge 52 is located in from the leading edge 12 of the garment and the trailing edge 54 of the elastic tape 50 is located in from the trailing edge 14 of the garment 10. The sewing operation to produce this version of applicants' invention differs from that used to produce the above discussed prior art garment in that although the continuous binding tape 30 is always in the binder tape folder and extends under the presser foot the elastic tape 50 is not. The trailing edge of the elastic tape 50 is severed before the sewing operation of a garment is completed. After the sewing operation of a garment is completed the new leading edge of the elastic tape is fed into the binder tape folder short of the presser foot. After the sewing operation for the next garment has commenced the elastic tape is fed toward the presser foot of the sewing machine such that its leading edge 52 trails the leading edge 12 of the fabric 10 by a length identified as L which in this particular product is about one inch. During the sewing operation of this garment the elastic tape is severed, thus producing a trailing edge 54 for the elastic tape being applied to a garment and a new leading edge 52 for the next garment to be manufactured. The elastic tape 50 is severed at a location such that its trailing edge 54 leads the trailing edge 14 of the garment 10 by a length L. In this version of applicants' invention the elastic tape 50 is stitched continuously, from its leading edge 52 to its trailing edge 54, to the binder tape and fabric 10 throughout its length. In the preferred embodiment the trailing edge 14 of the fabric 10 is sensed and the elastic tape 50 is severed a predetermined stitch count after the trailing edge 14 is recognized. Alternatively the elastic tape could be severed a predetermined stitch count after the leading edge 12 of the fabric 10 has been sensed or a predetermined stitch count after the sewing operation commences. In this version of applicants' invention stitched lengths of binder tape connect consecutive garments which are severed at their mid points. The lengths W that are removed in the next sewing operation do not include elastic tape and thus the cost of the waste has been greatly reduced. Also in the next sewing operation, in which the leading 12 and trailing 14 edges are lapped over each other and seamed, the portions of the bound edges that are lapped over each other do not include elastic tape and thus are less bulky. As can be best seen in cross section view FIG. 2A the elastic tape 50 has been applied against the bottom surface 20 of the fabric 10. Since the bottom surface 20 is the inside of the garment it is immaterial whether the edge 53 of elastic tape 50 is visible.

FIGS. 3, 3A and 3B illustrate another version of applicants' invention. In this version of applicants' invention the sewing operation differs somewhat from that used to produce applicants' version of his invention illustrated in FIGS. 2 and 2A. In producing the version of applicants' invention seen in FIGS. 3, 3A and 3B the leading edge 52 of elastic tape 50 again trails the leading edge 12 of garment 10. After the leading edge 52 of the elastic tape has been securely attached to the fabric 10 and binder tape 30, the elastic tape 50 is sidestepped out of the path of the sewing needles such that it is not stitched. The trailing edge 54, of elastic tape 50 is shifted back into the path of sewing needles, so that it will become attached to the fabric 10 and the binding tape 30. FIG. 3A is a cross section view taken along lines A—A of FIG. 3 and FIG. 3B is a cross section view taken along lines B—B of FIG. 3. In FIG. 3A the stitching extends through the fabric 10, binding tape 30 and elastic tape 50. In FIG. 3B the tape 50 has been jogged to one side such that it is not stitched to the fabric 10 or the binder tape 30.

FIGS. 4 and 4A illustrate another version of applicants' invention. In this version of applicants' invention the foot opening in a pair of sweat pants is being bound with an elastic tape 50 stitched into the bound edge. In this version the fabric 10 of the sweat pants is folded over upon its self rather than applying a separate binding material tape. When performing this continuous sewing operation a chain 33, made up of thread, if formed between consecutive garments or between the two legs of a garment. After completing the stitching across one piece of fabric 10 the leading edge 52 of the elastic tape 50 for the next garment leg is advanced to the material folder short of the sewing machine presser foot. The operator loads the leading edge 12 of a piece of fabric 10 into the material folder under the presser foot. When the leading edge 12 of fabric 10 reaches the stitch forming area the sewing operation begins. At a predetermined stitch count following the leading edge 12 or after the sewing operation begins feeding of the elastic tape 50 commences, such that the leading edge 52 of the elastic tape trails the leading edge 12 of the fabric 10 by a length L. The chain 33 that connects successive garment legs can be automatically severed between garment legs by actuating a chain cutter a predetermined stitch count after sensing the leading edge 12 of the garment leg or in the alternative a predetermined stitch count after starting the sewing operation. The elastic tape 50 is severed at a location such that its trailing edge 54 will lead the trailing edge 14 of the fabric 10 by a length L.

Figure 6:
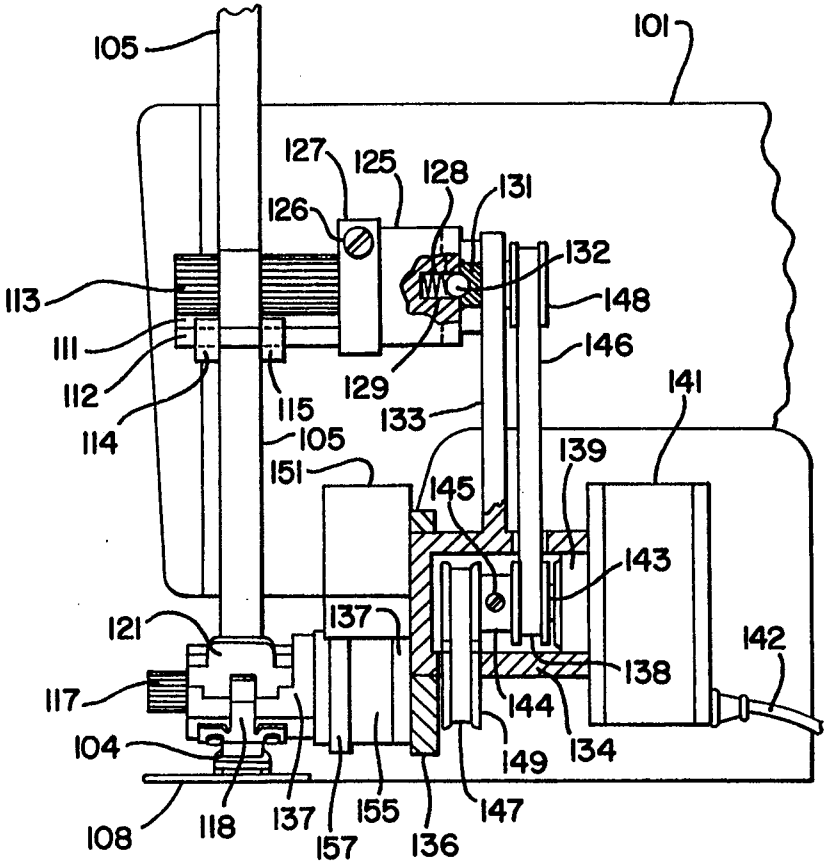
FIG. 6 PRIOR ART
FIG. 6 is a front view of the prior art tape feed device seen in FIG. 5.
Figure 5:
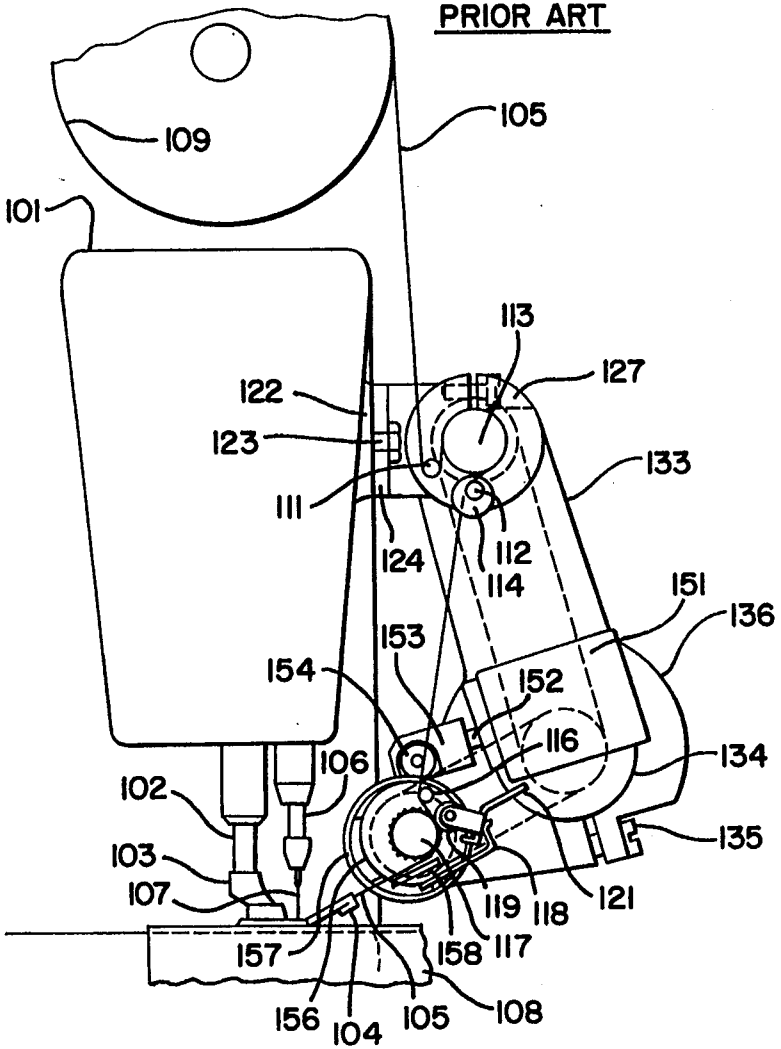
FIG. 5 PRIOR ART
FIG. 5 is a side view of a prior art tape feed device mounted on a sewing machine.

Applicants' have modified and improved an existing elastic tape feeder for use as a component of their device. The existing elastic tape feeder is disclosed in U.S. Pat. No. 4,922,843 which is incorporated herein by this reference. FIGS. 5 and 6 which have been labeled as "PRIOR ART" are Figures of U.S. Pat. No. 4,922,843 and the following discussion of these Figures is a description of this prior art.

As shown in FIGS. 5 and 6, a tape feed device is disposed on the sewing machine housing 101. The sewing machine has a presser rod 102 and foot 103 having a funnel-shaped opening 104 for receiving a tape 105. A needle bar 106 carries a needle 107 which passes through both the tape 105 and the workpiece 108 during a sewing operation.

The tape 105 delivered from a supply 109 passes around two deflecting guides 111 and 112 and a feed roll 113, whose effective diameter is larger than that of the drive roll 117. The tape 105 is guided at the side by adjusting rings 114 and 115 respectively, which are secured to the deflecting guide 112. A further deflecting guide 116 guides the tape 105 between the drive roll 117 and a roll 119 which is pressed against the tape 105 by a leaf spring 118. To facilitate insertion of the tape 105, the roll 119 has a manual control 121 by which the roll 119 can be lifted off the tape 105 and drive roll 117.

The housing 101 has a boss 122 to which a cranked support 124 is fastened by a screw 123. The cranked support 124 carries an annular hollow body 125 in which the feed roll 113 is rotatably mounted. A slit ring 127, which carries the two deflecting guides 111 and 112, is secured to the annular hollow body 125 by a screw 126. A pressure spring 129 is located in a side opening 128 in the annular hollow body 125 and presses a ball 131 into one of a plurality of recesses 132 in a holder 133 disposed concentrically to the feed roll 131. Due to the plurality of the recesses 132 in holder 133 disposed concentrically to feed roll 131 and due to the spring clamped ball 131 it is possible to set holder 133 in predetermined registered positions, such that the feed roll holding member (holder 133) is pivotally mounted on the machine housing.

The lower end of the holder 133 carries a hollow bearing boss 134 on which a holder 136 is secured by a screw 135 as shown in FIG. 5. When loosening the screw 135, it is possible to adjust the holder 136 relative to the holder 133 thus forming a joint. A hollow support element 137 is secured to the side of the holder 136 and the drive roll 117 is rotatably mounted therein.

A collar 139 of a stepping motor 141 projects into a receiving opening 138 of the bearing boss 134, the stepping motor being connected by way of a cable 142 to a control device.

A shaft 143 of the stepping motor 141 carries a double toothed belt pulley 144, which is fastened to the shaft 143 by a screw 145. Toothed belts 146 and 147 respectively drive the feed roll 113 and drive roll 117 byway of further toothed belt pulleys 148 and 149. The effective diameter of the double toothed belt pulleys 144 is the same as that of the other toothed belt pulleys 148 and 149. As a result, the feed roll 113 has a greater peripheral speed than the drive roll 117. As the ratio between the toothed belt pulleys is 1:1:1 and due to the fact that the effective diameter of the feed roll 113 is larger than that of the drive roll 117 the peripheral speed of the feed roll 113 is greater as compared to the peripheral speed of the drive roll 117. Therefore, feed roll 113 is capable of feeding more tape than the drive roll 117.

A piston and cylinder mechanism 151, which is acted upon by pressure medium and which is controlled by way of supply lines, actuates by way of a piston rod 152 and a forked head 153 a roll 154 which is mounted on a knife holder 155 pivotable about the support element 137. A curved knife 156 is detachably fastened by a tensioning ring 157 to the pivotable knife holder 155. A further knife 158 is carried by the support element 137. The two knives 156 and 158 are disposed about the drive roll 117.

The tape feed device operates as follows:

When the tension of the tape 105 between the drive roll 117 and supply 109 increases, the loose tape 105 becomes tight about the feed roll 113. As a result, more tape 105 is delivered from the supply 109 until tape 105 is being provided to the drive roll 117 with a constant, low tension. Once this has been achieved, the tape 105 winds loosely about the feed roll 113 and tape is actually conveyed only by the drive roll 117, until the tension between the drive roll 117 and supply 109 increases again.

With this tape feed device, it is possible to apply tape 105 to the work material 108 both with and without pre-tension, since the pre-tension between the drive roll 117 and the needle 107 is controlled by the stepping motor 141. The feed roll 113 ensures that tape 105 is fed evenly to the drive roll 117.

The joint which is formed between the holders 133 and 136, makes it possible to align the drive roll 117 precisely with the needle 107 and presser foot 103 of the sewing machine.

In order to provide ready access to the sewing location for service and attention, the tape feed device is pivotable about the axis of the roll 113 and can be resiliently retained in predetermined registered positions in front of the sewing location of the sewing machine.

The knives 156 and 158 disposed about the drive roll 117 enable the tape 105 to be cut immediately adjacent to the sewing location. The tape feed device can be resiliently adapted to feed two or more tapes of the same or differing widths.

Figure 7:
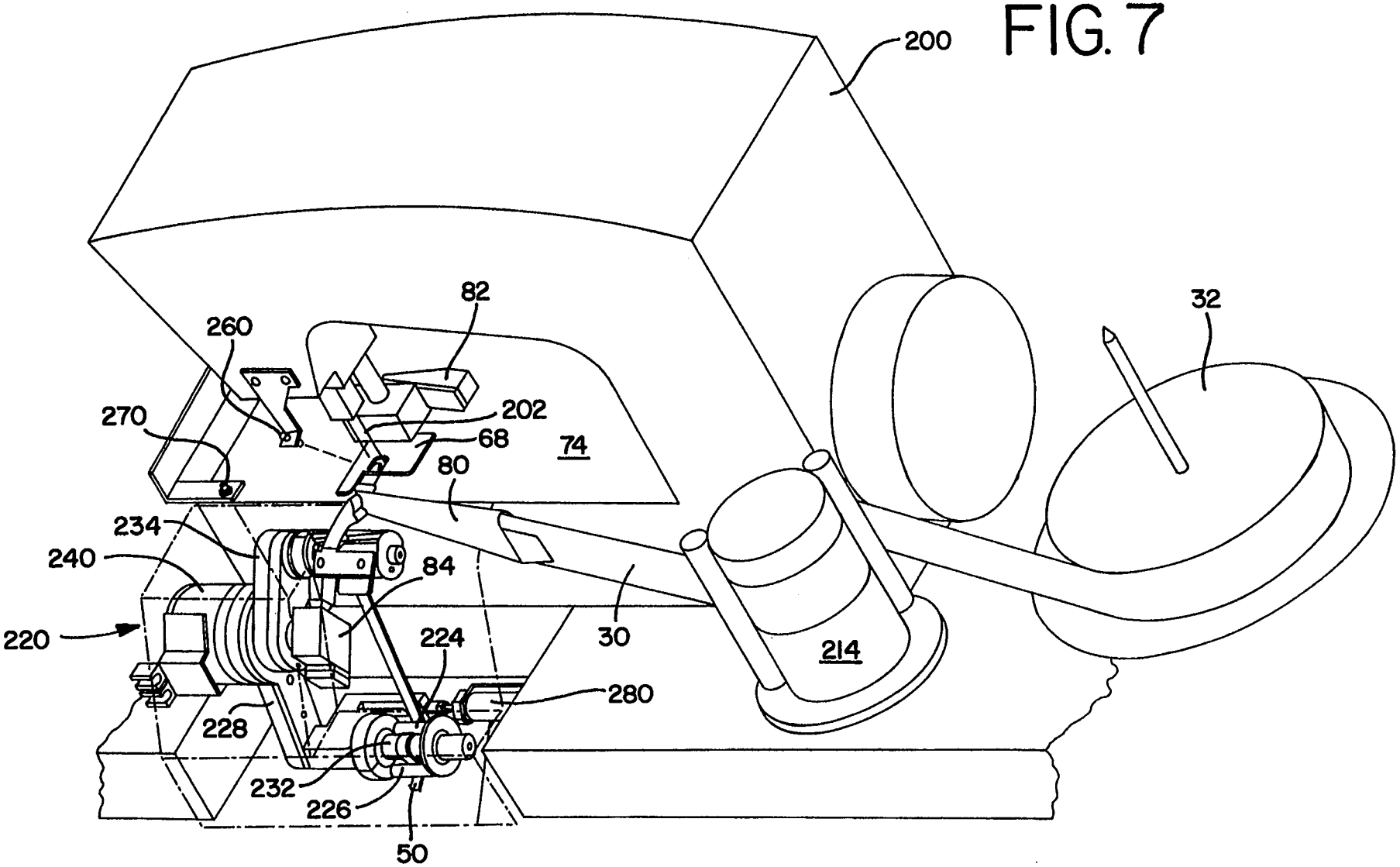
FIG. 7 is a perspective view of a sewing machine including a version of applicants device mounted thereon.

FIG. 7 is a perspective view of a sewing machine including a sewing head 200 that has a version of applicants' device mounted thereon. The sewing head 200 includes conventional stitch forming mechanism such as pair of laterally spaced reciprocating needles 202, a presser foot 68, feed dogs and a work support surface 74. The sewing machine of course includes the conventional sewing machine drive motor having a power switch and start switch.

A binder folder 80 is mounted on the sewing machine relative to the work support surface 74 such that folded binder tape 30 is fed beneath the presser foot 68. The binder tape 30 extends from a source 32 through a deflector mechanism 214 to the binder folder 80. It should be noted that the binder folder 80 bends sharply at a point in front of the presser foot and directs the folded binder tape toward and under the presser foot 68 in the direction of material feed.

The elastic tape feeder 220 is located below the work support surface 74 where it does not obstruct the operator's view of the stitch forming mechanisms. For a purpose that will be discussed later in the specification the elastic tape feeder 220 is mounted such that it can slide laterally of the direction of material feed.

As stated earlier applicants have modified an existing elastic tape feeder for use as a component of their device. The elastic tape feeder 220 receives elastic tape 50 from a source (not shown) at the driven feed roll 232. The tape winds around deflecting guides 226 and 224 which hold the tape 50 into contact with driven feed roll 232. The driven feed roll 232 and guides 224, 226 are carried at the free end of an arm 228. The drive for driven feed roll 232 extends from a stepper motor 240 through arm 228. The stepper motor 240 receives signals from the micro-computer control system which causes stepper motor 240 to rotate a precise number of rotations or fraction of a rotation. The stepper motor 240 can be controlled to advance the elastic tape 50 a distance that is equal to a predetermined stitch count. The microcomputer control system receives a signal indicating the sewing speed and stitch lengths which is a factor in calculating the proper signals to be sent to the stepper motor 240.

A second arm 234 extends upwardly from the stepper motor 240 and supports the discharge portion of the elastic tape feeder 220 which has a generally cylindrical shape. The discharge portion includes a driven drive roll 235 and will be described in more detail with reference to FIG. 7A. The drive for drive roll 235 extends from stepper motor 240 through arm 234.

A binding cutter sensor 260, supported by the sewing head 200, is aimed at a point immediately in front of the presser foot 68 such that it will sense and recognize the leading edge 12 (see FIG. 2) of the garment. The microcomputer is programmed to actuate a binder cutter 82 a predetermined stitch count after the leading edge 12 of the garment is sensed. This predetermined stitch count is calculated such that the stitched binder section that connects consecutive garments will be severed at its mid portion or close to the leading edge.

The preferred sensors for use in the device of this invention are of the retroreflector type in which emitted rays are reflected back to the sensor. The emitted rays are directed at a highly reflective surface, or a surface to which reflective tape has been applied. When a ply of material moves into the area where the rays are directed there is a change in the rays that are reflected back to the sensor. This change is detected by the sensor and the change is transmitted to the control system. The sensors transmit signals to the micro processor control system 300. The signal being transmitted by the sensors changes when a sensor detects the presence or absence of a ply of material. The micro processor is programmed to respond to the changes in the signals that it receives from the sensors by sending operating instructions to various components.

Diffuse type sensors could also be used. Diffuse type sensors recognize characteristics of a particular type of surface that they are intended to sense and do not require the presence of a highly reflective surface.

The micro-computer is also programmed to send a signal to the stepper motor 240 a predetermined stitch count after sensing the leading edge 12 of the garment that will cause driven feed roll 232 and driven drive roll 235 to feed elastic tape 50 through the binder folder 80 toward the under surface of the garment. The predetermined stitch count is calculated such that the leading edge 52 of elastic tape 50 will trail the leading edge 12 of the garment by an amount L. (see FIG. 2)

A elastic tape feeder cutter sensor 270 is mounted on the sewing head 200 and aimed at a point over which the trailing edge 14 of the garment will pass. When sensor 270 recognizes the garment trailing edge 14 a signal is sent to the micro-computer control system. The micro-computer control system processes this signal and generates a signal that it sends to the solenoid mechanism 84 that actuates the elastic tape movable knife 244 (see FIG. 7A). This signal is sent to solenoid mechanism 84 a predetermined stitch count after the trailing edge 14 of the garment has been recognized. The predetermined stitch count is calculated such that the elastic tape is severed so that the trailing edge, of the elastic tape being stitched to the garment, leads the trailing edge 14 of the garment being stitched.

An air cylinder 280 is anchored to the sewing machine frame and connected to the elastic tape feeder 220. The air cylinder 280 is arranged such that when it expands or contracts the entire elastic tape feeder 220 slides laterally. This feature of applicants' invention is used to laterally shift or adjust the position that the elastic tape is fed to the garment, for example when producing a garment of the type shown in FIG. 3.

Figure 7A:
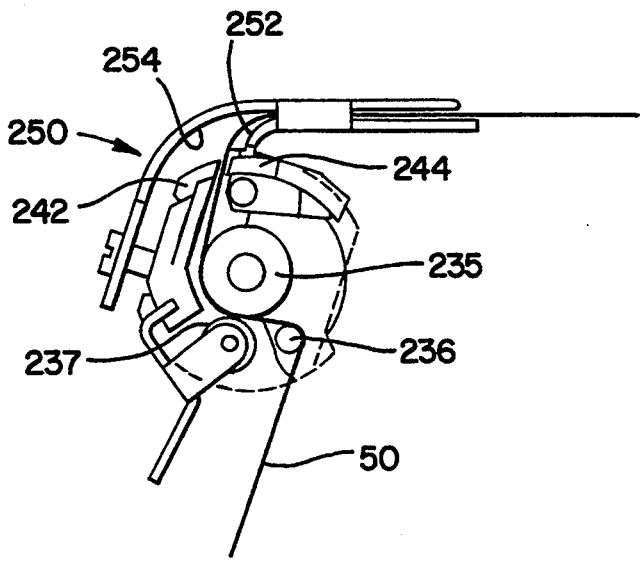
FIG. 7A is an enlarged view of a portion of the tape feed device of FIG. 7 with the end removed to better illustrate internal components.

FIG. 7A is an enlarge end view of the discharge portion of the elastic tape feeder 220 seen in FIG. 7. In this view an end cover plate has been removed to better show internal components. The discharge portion has a driven drive roll 235 at its central axis which is driven by stepper motor 240 through arm 234. A deflecting guide 236 and a spring biased roll 237 maintain the elastic tape 50 in engagement with drive roll 235. A stationary knife 242 and a cooperating movable knife 244 are located at the peripheral of the discharge portion and are concentric with drive roll 235. The stationary knife 242 and movable knife 244 are mounted such that when movable knife 244 is actuated it severs the tape 50 as it is being fed from the discharge portion of the elastic tape feeder 220. The movable knife is actuated by a solenoid mechanism 84 which is energized by a signal from the micro-computer control system. Applicants' have added to the prior art tape feed device, shown in FIGS. 5 and 6, a tape guide 250 including converging guide surfaces 252 and 254 that are secured to the discharge portion. After the tape 50 has been severed by knives 242 and 244 it will, in response to a signal given to stepper motor 240, be driven from the elastic tape feeder 220 in a tangential direction by drive roll 235. The new leading edge 52 of the tape 50 will encounter guide surfaces 252 and 254 as it is fed tangentially from the discharge portion of the elastic tape feeder 220 and will be directed by guide surfaces 252 and 254 through the tape guide 250. The tape guide 250 is arranged to feed the tape 50 into the material folder 2 in the direction of material feed. At this time in the process the new leading edge 52 of elastic tape 50 stops short of the presser foot. It will be driven again by drive roll 235 at a predetermined stitch count after the leading edge 12 of the garment is recognized by sensor 260. Applicants' tape guide 250 is important to the proper operation of their device since it enables the elastic tape to be fed to the stitch forming mechanism of the sewing machine even though the elastic tape feeder 220 can not be seen by the operator. The prior art elastic tape feeder was in full view of the operator who could assist and control the feeder to insure the proper loading of the elastic tape. In applicants' device the elastic tape feeder 220 can not be seen by the operator during the sewing operation and thus it is important that the elastic tape feeder have the capability to accurately and reliably load the elastic tape into the material folder.

The phantom lines in FIG. 7 represent a removable cover that shrouds the elastic tape feeder 220.

FIGS. 8 and 8A through 8E is a series of simplified end view sketches of applicants' preferred device that will be utilized to discuss the starting cycle of applicants' preferred process or method.

Figure 8A:
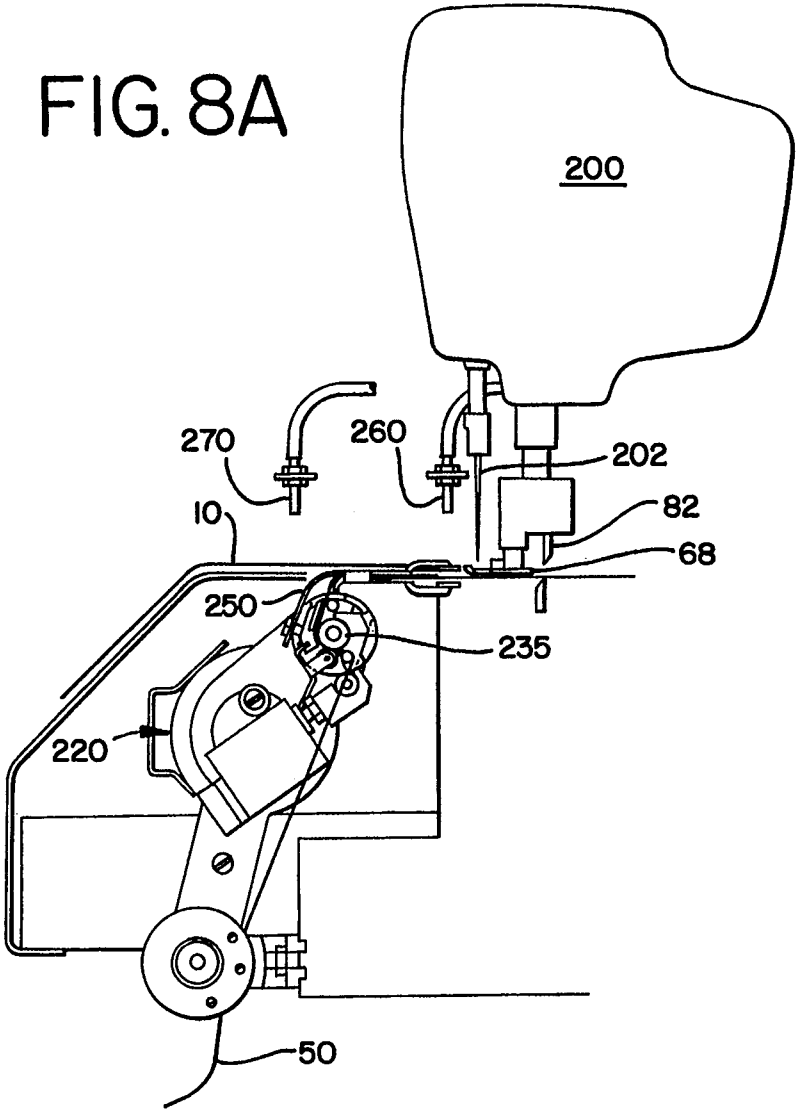
FIGS. 8, 8A, 8B, 8C, 8D and 8E are schematic side views of a sewing machine and applicants' tape feeder device showing progressive steps in the method of assembling a garment.
Figure 8:
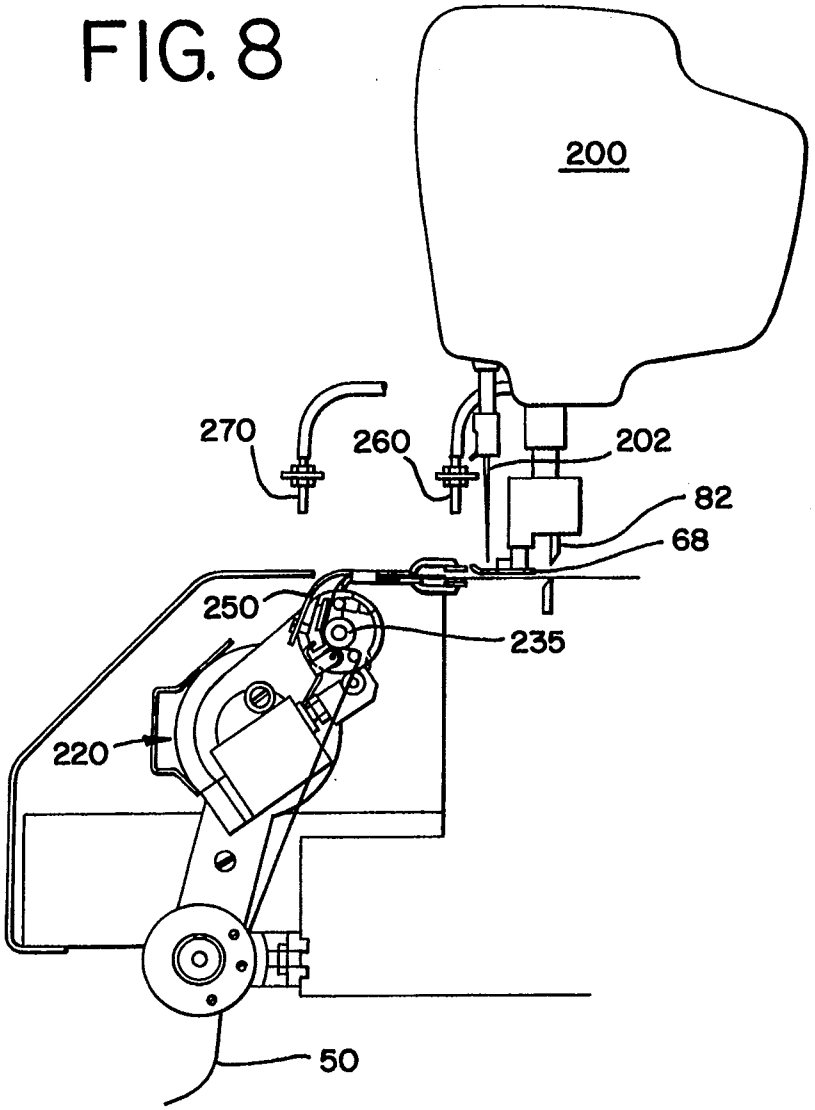

In FIG. 8 the elastic tape 50 is threaded around the driven feed roll 232 and driven drive roll 235 of the elastic tape feeder 220 and has been metered into the tape guide 250. The leading edge 52 of elastic tape 50 stops short of the presser foot 68. In this view the garment fabric 10 has not been loaded into the material folder 2 by the operator. It should be noted that although not shown in this simplified view the binder tape 30 extends under the presser foot 68.

In FIG. 8A the garment fabric 10 has been loaded into the material folder 2 by the operator, however sewing has not started. It should be noted that the garment fabric 10 lies on the outside surface of the cover that is represented by phantom lines in FIG. 7.

Figure 8C:
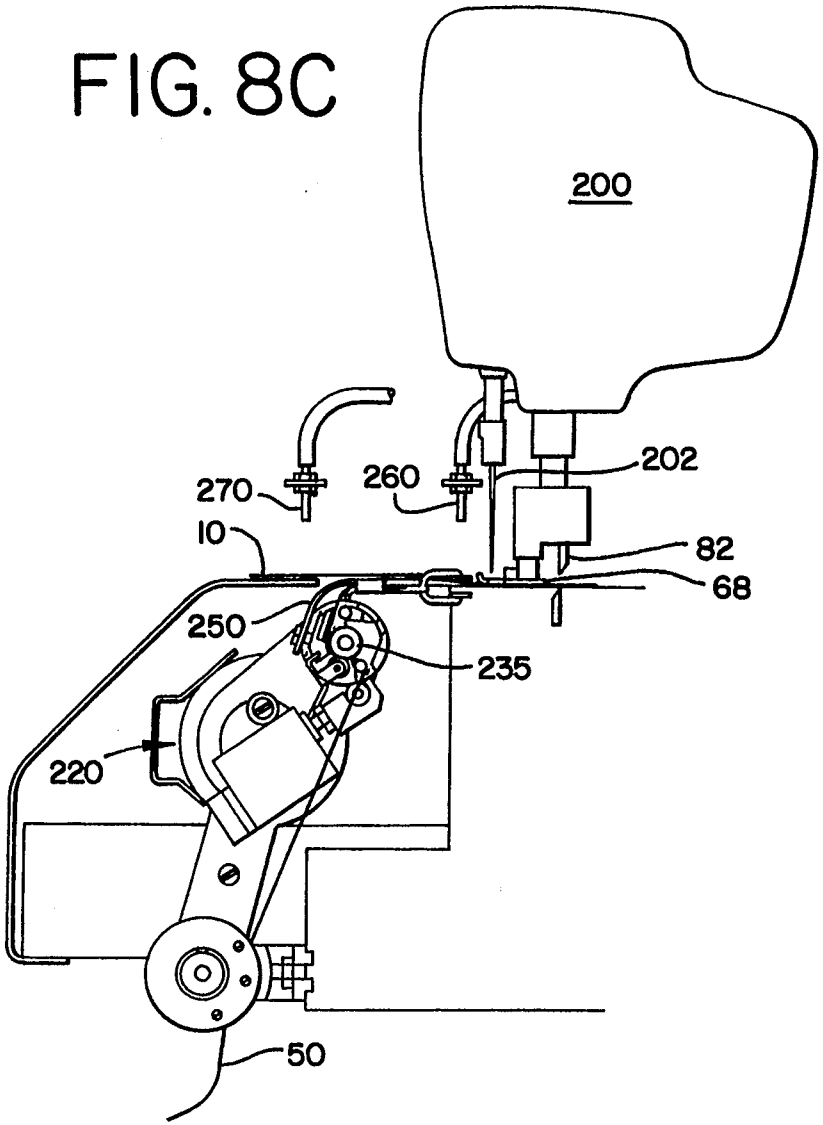
Figure 8B:
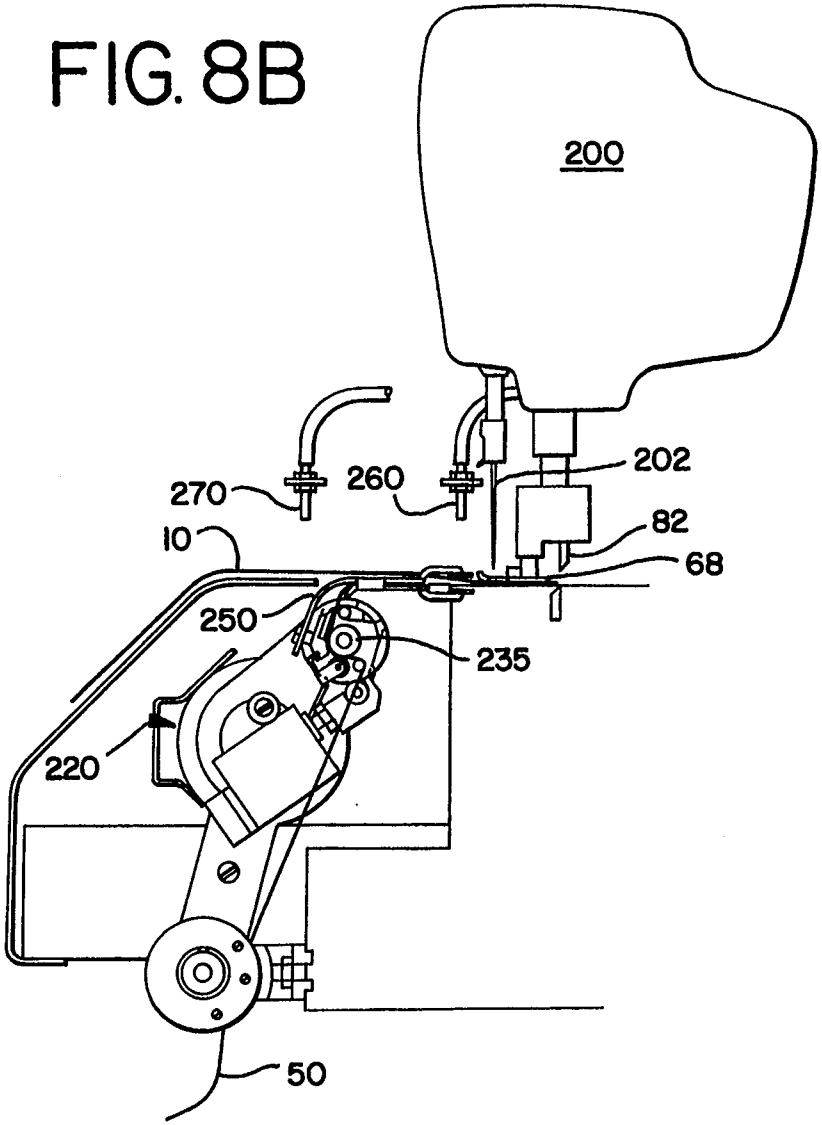

In FIG. 8B the sewing operation has started, however the elastic tape has not been fed under the presser foot 68. At this stage of the process the folded binder tape is being sewn to the margin edge of the garment fabric 10. As sewing continues the leading edge 12 of the garment will be sensed, and after a predetermined stitch count the binder material that connects consecutive garments will be severed by the binder cutter 82 and the elastic tape will be fed.

In FIG. 8C the elastic tape 50 has been fed to the bottom surface of the garment fabric 10 and is being sewn to the garment fabric 10 and the binder tape 30.

Figure 8E:
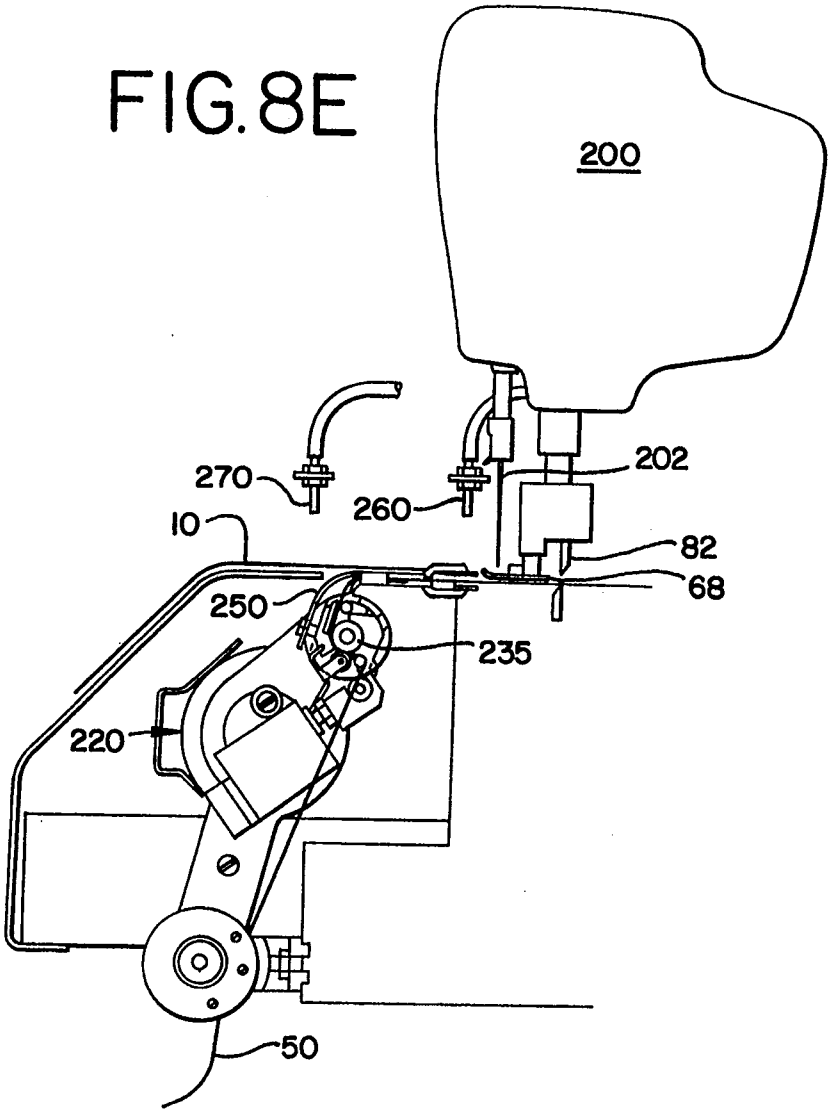
Figure 8D:
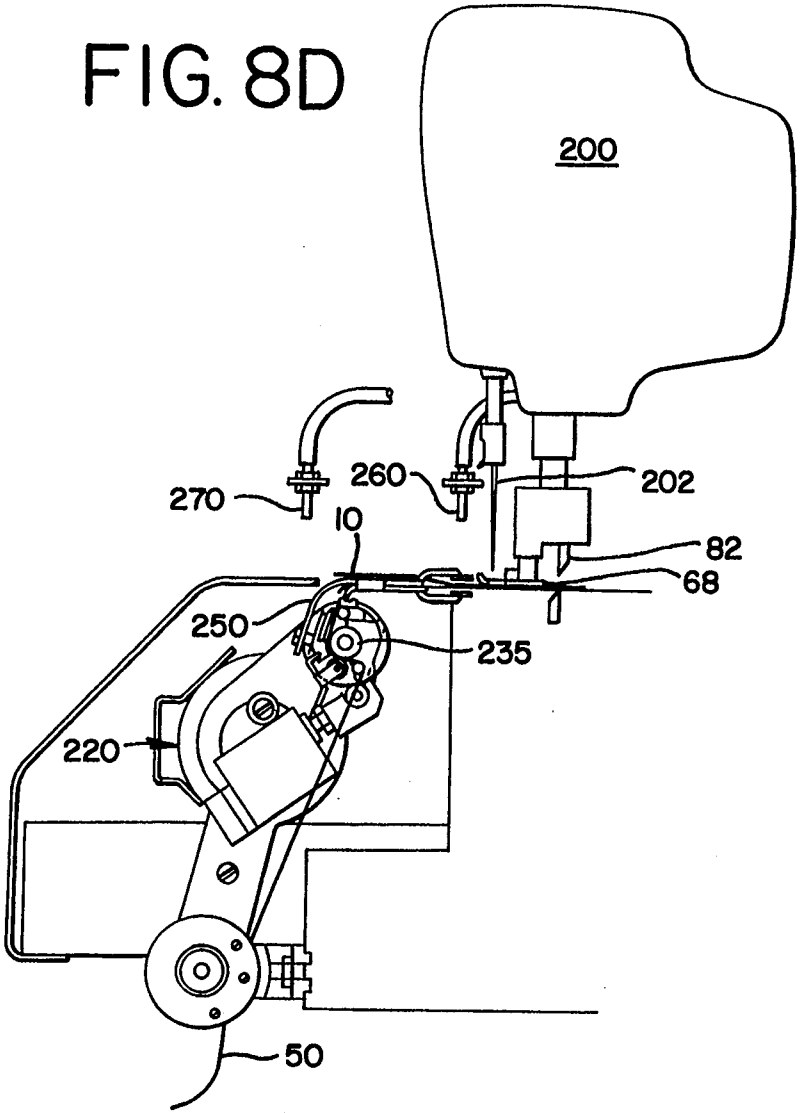

In FIG. 8D the elastic tape 52 has been cut by knives 242,244 in response to the trailing edge 14 of the garment being recognized or uncovered by the tape feeder cutter sensor 270.

FIG. 8E shows the sewing cycle completed and the elastic tape 50 and garment fabric 10 are again as they were in FIG. 8A.

Figure 9:
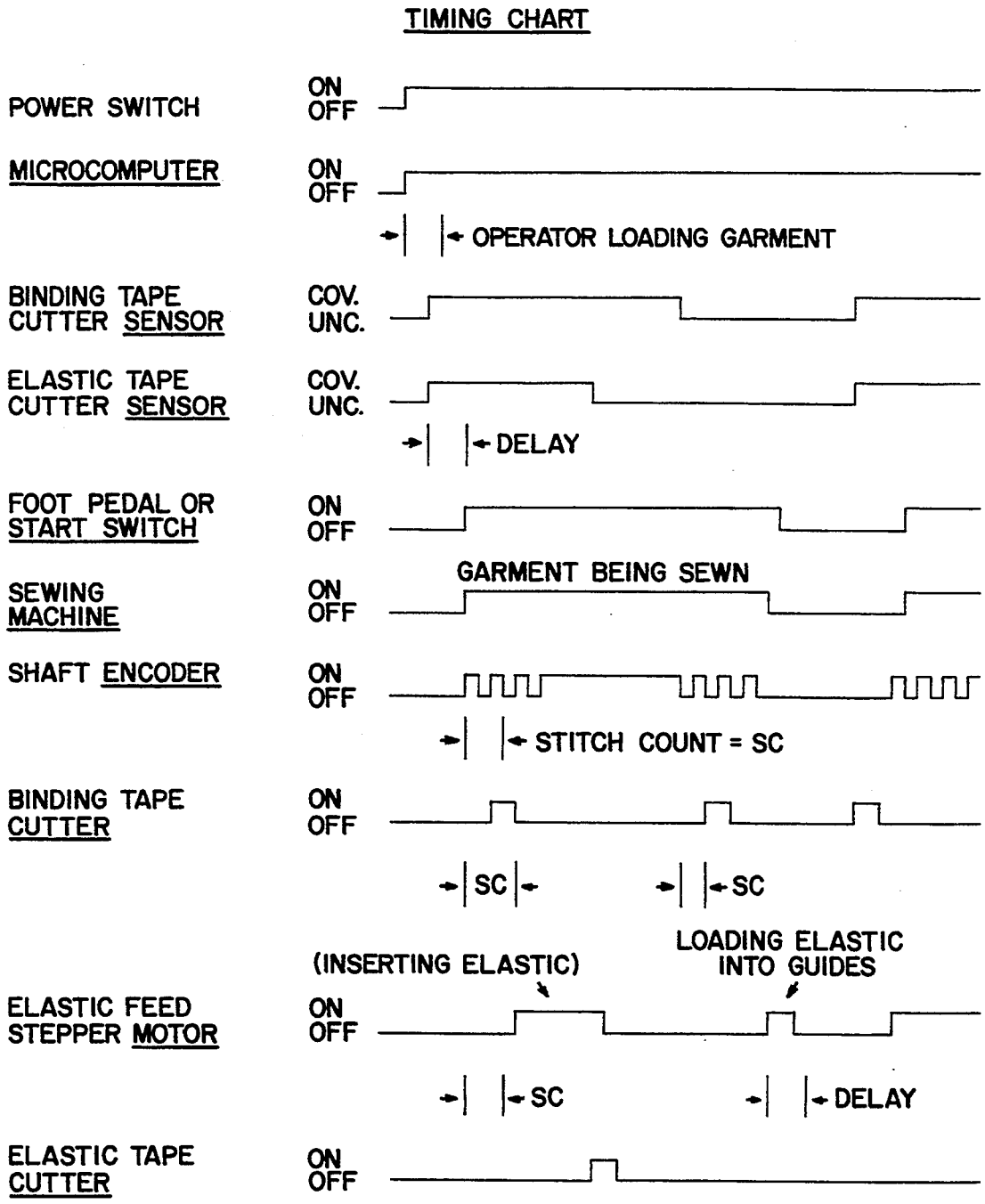
FIG. 9 is a timing chart for a sewing machine including the device of this invention.

FIG. 9 is a Timing Chart for applicants' preferred process or method. The first and second lines of this chart, Power Switch and Micro Computer, represent the initial step of turning the power on. The third line of the chart, Binding Tape Cutter Sensor, indicated that there is a time delay after the power is turned on, during which this sensor is "uncovered" until this sensor is "covered" by the leading edge of the garment. The operator loads the garment during this time delay.

The fourth line of this chart, Elastic Tape Cutter Sensor also is "uncovered" at the time power is initially turned on and there is a time delay until this sensor is "covered".

The fifth line of this chart is identified as, Foot Pedal or Start Switch. The start switch could be a function performed by the Control System to automatically start the sewing machine. These switches could also be manually activated by the operator. The sixth line of the chart, Sewing Machine, indicated that sewing of the garment commences when the Foot Pedal or Start Switch is activated.

The seventh line of the chart, Shaft Encoder, indicates that the shaft encoder begins counting shaft rotations at the time that the sewing operation begins. It should be noted that one stitch is formed for each shaft rotation, and thus there is a direct relationship between shaft rotation and stitch count.

The eighth line of the chart, Binding Tape Cutter, shows that the binder tape cutter is actuated a predetermined stitch count after an earlier event. The earlier event could be either the starting of sewing or sensing the leading edge of the garment.

The ninth line of the chart, Elastic Feed Stepper Motor, indicates that the stepper motor is activated after a delay and then begins feeding the elastic tape to the stitch forming mechanism. At a predetermined stitch count following uncovering of the elastic tape cutter sensor (line four) the elastic feed stepper motor is turned off. The elastic feed stepper motor will be turned on again to load the new leading edge of the elastic tape into the material guides.

The tenth line of the chart, Elastic Tape Cutter shows that this cutter is actuated when the elastic feed stepper motor stops feeding the elastic tape, which occurs for example a predetermined stitch count after the trailing edge of the fabric is sensed.

Figure 10:
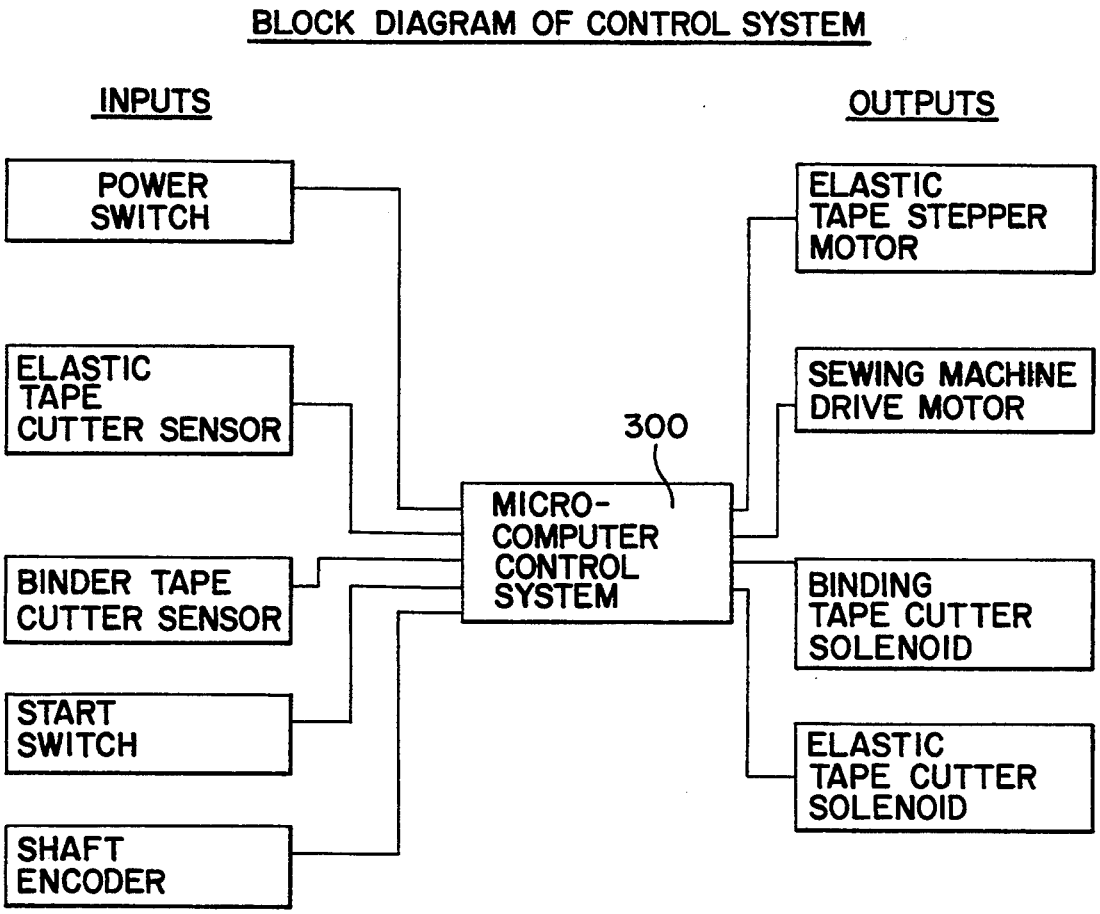
FIG. 10 is a block diagram of the microcomputer control system for a sewing machine including the device of this invention.

FIG. 10 is a block diagram showing the inputs that are fed into the micro-computer control system 300 and the outputs that flow therefrom to the sewing machine and its components. The micro-computer can of course be programmed to react to inputs in different ways, for example as the garment size changes or a different garment is being stitched a different predetermined stitch count may be required.

It is intended that the accompanying Drawings and foregoing detailed description is to be considered in all respects as illustrative and not restrictive, the scope of the invention is intended to embrace any equivalents, alternatives, and/or modifications of elements that fall within the spirit and scope of the invention, and all changes which come within the meaning and range of equivalency of the claims are therefore intended to be embraced therein.

What is claimed is:

1. A method of binding the edges of a consecutive series of garments and inserting an elastic tape within the bound edge, such that for each garment the leading edge of said elastic tape trails the leading edge of the garment and the trailing edge of the elastic tape leads the trailing edge of the garment, which comprises the steps of:

(a) loading the leading edge of an elastic tape into a material folder which is loaded with a binder material tape;

(b) loading the leading edges of the garment on top of the elastic tape and into the material folder such that the binder material tape extends along the edge of the garment to be bound;

(c) advancing the garment and binder material tape such that both the garment and the binder material tape are under the presser foot of the sewing machine;

(d) starting the stitching operation;

(e) sensing the leading edge of the garment;

(f) advancing the elastic tape through the material folder against the bottom surface of the garment and toward the presser foot, commencing after a predetermined stitch count following sensing the leading edge of the garment;

(g) sewing the elastic tape to the garment and binder material tape;

(h) sensing the trailing edge of the garment;

(i) actuating an elastic tape cutter to sever the elastic tape at a point that the severed trailing edge of the elastic tape is stitched to the garment and binder material tape before the trailing edge of the garment is reached, after a predetermined stitch count following sensing the trailing edge of the garment.

2. The method as set forth in claim 1 in which after step (e) the following step is performed:

(j) actuating a binder cutter a predetermined stitch count after the leading edge of the garment is sensed to sever the garment being stitched from the preceding stitched garment.

3. The method as set forth in claim 1 in which the advancing speed of the elastic tape is synchronized with the sewing speed such that the elastic tape is advanced at the same speed as the binder material tape and the garment.

4. The method as set forth in claim 1 in which the advancing speed of the elastic tape is synchronized with the sewing speed such that the elastic tape is advanced at a slower speed than the binder material tape and the garment.

5. The method as set forth in claim 1 in which after step (h) has commenced, momentarily reversing the advancing of the elastic tape to place tension on the elastic tape and produce a gathered seam.

6. A method of binding the edges of a consecutive series of garments and inserting an elastic tape within the bound edge, such that for each garment the leading edge of the elastic tape trails the leading edge of the garment, which comprises the steps of:

(a) loading the leading edge of a continuous elastic tape into a material folder which is loaded with a binder material tape;

(b) loading the leading edges of the garment on top of the elastic tape and into the material folder such that the binder material tape extends along the edge of the garment to be bound;

(c) advancing the garment and binder material tape such that both the garment and binder material tape are under the presser foot of the sewing machine;

(d) starting the stitching operation;

(e) sensing the leading edge of the garment;

(f) advancing the elastic tape through the material folder against the bottom surface of the garment and toward the presser foot, commencing after a predetermined stitch count following sensing the leading edge of the garment;

(g) sewing the elastic tape to the garment and binder material tape;

(h) sensing the trailing edge of the garment;

(i) actuating an elastic tape cutter to sever the elastic tape, after a predetermined stitch count following sensing the trailing edge of the garment.

7. The method as set forth in claim 6 in which after step (e) the following step is performed:

(j) actuating a binder cutter a predetermined stitch count after the leading edge of the garment is sensed to sever the garment being stitched from the preceding stitched garment.

8. The method as set forth in claim 6 in which the advancing speed of the elastic tape is synchronized with the sewing speed such that the elastic tape is advanced at the same speed as the binder material tape and the garment.

9. The method as set forth in claim 6 in which the advancing speed of the elastic tape is synchronized with the sewing speed such that the elastic tape is advanced at a slower speed than the binder material tape and the garment.

10. The method as set forth in claim 6 in which after step (g) has commenced, momentarily reversing the advancing of the elastic tape to place tension on the elastic tape and produce a gathered seam.

11. A method of binding the edges of a consecutive series of garments and inserting an elastic tape within the bound edge, such that for each garment the trailing edge of the elastic tape leads the trailing edge of the garment, which comprises the steps of:

(a) loading the leading edge of an elastic tape into a material folder which is loaded with a binder material tape;
(b) loading the leading edges of the garment on top of the elastic tape and into the material folder such that the binder material tape extends along the edge of the garment to be bound;
(c) starting the stitching operation;
(d) advancing the elastic tape through the material folder against the bottom surface of the garment and toward the presser foot;
(e) sensing the leading edge of the garment;
(f) sewing the elastic tape to the garment and binder material tape;
(g) sensing the trailing edge of the garment;
(h) actuating an elastic tape cutter to sever the elastic tape at a point that the severed trailing edge of the elastic tape is stitched to the garment and binder material tape before the trailing edge of the garment, after a predetermined stitch count following sensing the trailing edge of the garment.

12. The method as set forth in claim 11 in which after step (e) the following step is performed:

(i) actuating a binder cutter a predetermined stitch count after the leading edge of the garment is sensed to sever the garment being stitched from the preceding stitched garment.

13. The method as set forth in claim 11 in which the advancing speed of the elastic tape is synchronized with the sewing speed such that the elastic tape is advanced at the same speed as the binder material tape and the garment.

14. The method as set forth in claim 11 in which the advancing speed of the elastic tape is synchronized with the sewing speed such that the elastic tape is advanced at a slower speed than the binder material tape and the garment.

15. The method as set forth in claim 11 in which after step (f) has commenced, momentarily reversing the advancing of the elastic tape to place tension on the elastic tape and produce a gathered seam.

16. A method of binding the edges of a consecutive series of garments and inserting an elastic tape within the bound edge, such that for each garment the leading edge of said elastic tape trails the leading edge of the garment and the trailing edge of the elastic tape leads the trailing edge of the garment, which comprises the steps of:

(a) loading the leading edge of an elastic tape into a material folder which is loaded with a binder material tape;
(b) loading the leading edges of the garment into the material folder such that the binder material tape extending along the edge of the garment to be bound;
(c) advancing the garment and binder material tape such that both the garment and the binder material tape are under the presser foot of the sewing machine;
(d) starting the stitching operation;
(e) sensing the leading edge of the garment;
(f) advancing the elastic tape through the material folder against the bottom surface of the garment and toward the presser foot, commencing after a predetermined stitch count following sensing the leading edge of the garment;
(g) sewing the elastic tape to the garment and binder material tape;
(h) actuating an elastic tape cutter to sever the elastic tape at a point that the severed trailing edge of the elastic tape is stitched to the garment and binder material tape before the trailing edge of the garment is reached, after a predetermined stitch count following sensing the leading edge of the garment.

17. The method as set forth in claim 16 in which after step (e) the following step is performed:

(i) actuating a binder cutter a predetermined stitch count after the leading edge of the garment is sensed to sever the garment being stitched from the preceding stitched garment.

18. A method of binding the edges of a consecutive series of garments and inserting an elastic tape within the bound edge, such that for each garment the leading edge of said elastic tape trails the leading edge of the garment and the trailing edge of the elastic tape leads the trailing edge of the garment, which comprises the steps of:

(a) loading the leading edge of an elastic tape into a material folder which is loaded with a binder material tape;
(b) loading the leading edges of the garment into the material folder such that the binder material tape extends along the edge of the garment to be bound;
(c) advancing the garment and binder material tape such that both the garment and the binder material tape are under the presser foot of the sewing machine;
(d) starting the stitching operation;
(e) advancing the elastic tape through the material folder against the bottom surface of the garment and toward the presser foot, commencing after a predetermined stitch count following starting the stitching operation;
(f) sewing the elastic tape to the garment and binder material tape;
(g) actuating an elastic tape cutter to sever the elastic tape at a point that the severed trailing edge of the elastic tape is stitched to the garment and binder material tape before the trailing edge of the garment is reached, after a predetermined stitch count following starting the stitching operation.

19. The method as set forth in claim 18 in which after step (d) the following step is performed:

(i) actuating a binder cutter a predetermined stitch count after starting the stitching operation, to sever the garment being stitched from the preceding stitched garment.

20. A method of binding the edges of a consecutive series of garments and inserting an elastic tape within the bound edge, such that for each garment the leading edge of said elastic tape trails the leading edge of the garment and the trailing edge of the elastic tape leads the trailing edge of the garment, which comprises the steps of:

(a) feeding the elastic tape through a laterally shiftable elastic tape feeder that includes a discharge tape guide;

(b) loading the leading edge of an elastic tape from said discharge tape guide into a material folder which is loaded with a binder material tape such that the elastic tape is aligned to be stitched;

(c) loading the leading edges of the garment into the material folder such that the binder material tape extends along the edge of the garment to be bound;

(d) advancing the garment and binder material tape such that both the garment and binder material tape are under the presser foot of the sewing machine;

(e) starting the stitching operation;

(f) sensing the leading edge of the garment;

(g) actuating a binder cutter a predetermined stitch count after the leading edge of the garment is sensed to thus sever the garment being stitched from the preceding stitched garment;

(h) advancing the elastic tape through the material folder against the bottom surface of the garment and toward the presser foot, commencing after a predetermined stitch count following sensing the leading edge of the garment;

(i) sewing the elastic tape to the garment and binder material tape;

(j) shifting the elastic tape feeder and tape guide such that the elastic tape is fed into the material folder at a location where it is not aligned to be stitched;

(k) sensing the trailing edge of the garment;

(l) actuating an elastic tape cutter to sever the elastic tape at a point that the severed trailing edge of the elastic tape is stitched to the garment and binder material tape before the trailing edge of the garment; and (m) shifting the elastic tape feeder and tape guide such that the elastic tape is again aligned to be stitched, commencing the shifting after a predetermined stitch count following sensing the trailing edge of the garment, this predetermined stitch count having been calculated to insure that the trailing edge of the elastic tape is stitched to the garment and binder material tape.

21. The method as set forth in claim 20 in which the advancing speed of the elastic tape is synchronized with the sewing speed such that the elastic tape is advanced at the same speed as the binder material tape and the garment.

22. The method as set forth in claim 20 in which the advancing speed of the elastic tape is synchronized with the sewing speed such that the elastic tape is advanced at a slower speed than the binder material tape and the garment.

23. The method as set forth in claim 20 in which the advancing speed of the elastic tape is synchronized with the sewing speed such that the elastic tape is advanced at a faster speed than the binder material tape and the garment.

24. The method as set forth in claim 20 in which after step (h) has commenced, momentarily reversing the advancing of the elastic tape to place tension on the elastic tape and produce a gathered seam.

25. A garment edge construction comprising:

(a) a garment fabric having leading and trailing edges and outside and inside surfaces;

(b) a strip of binder material tape that is folded longitudinally and receives the edge of said garment to be bound within its fold such that the inner surface of the folded binder material tape is in engagement with the outside and inside surfaces of the garment fabric;

(c) the segment of the folded binder material tape that is in engagement with the outside surface of the garment being folded under along its free longitudinal edge such that the outside free longitudinal edge of the binder material tape is within the fold of the binder material tape;

(d) an elastic tape extending longitudinally along the edge of the garment to be bound in engagement with the inside surface of the garment and inner surface of the folded binder material tape;

(e) the leading edge of said elastic tape trailing the leading edge of the garment and the trailing edge of said elastic tape leading the trailing edge of the garment; and (f) stitching extending longitudinally along the edge of the garment to be bound, said stitching extending through both layers of the folded under edge of the binding material tape, the garment, the elastic tape, and the edge of the binder material tape that is in engagement with the inside surface of the garment;

(g) the leading and trailing edges of the garment being overlapped and stitched together to form a body opening;

(c) the overlapped leading and trailing edges of the garment being limited to those portions in which there is no elastic tape, to minimize the thickness and bulkiness of the overlapped area.

26. The invention as set forth in claim 25 in which the elastic tape was stretched while being stitched to the garment and binder material tape to thus produce a gathered seam.

27. The invention as set forth in claim 25 in which the elastic tape is stitched to the garment and binder material tape at its leading and trailing edges only and extends unattached through the bound edge from its stitched leading edge to its stitched trailing edge.

28. A sewing machine of the type having a control system and stitch forming mechanism and feed dogs that are controlled by the control system, and a work surface upon which garments to be stitched are supported wherein the improvement comprises;

an elastic tape feeder mounted on said sewing machine below said work surface for metering an elastic tape to the inside surface of a consecutive garment being stitched, said elastic tape feeder being driven by a stepper motor that is controlled by a signals from said control system, said stepper motor in response to a signal accurately meters out elastic tape at specified speeds and in lengths corresponding to predetermined stitch counts of the sewing machine, said elastic tape feeder includes a discharge feed guide for controlling and directing the elastic tape as it is metered from said elastic tape feeder, said elastic tape feeder also including an elastic tape cutter for severing the elastic tape at a location before the elastic tape enters said discharge feed guide, said elastic tape cutter including an actuating mechanism that can be energized by a signal from said control system; and a binder material tape folder mounted on said sewing machine, said binder material tape folder receiving a continuous binder material tape from a binder material tape source, folding the binder material tape and directing the folded binder material tape under the presser foot in the direction of material feed and to align the folded binder material tape along the edge of the garment to be bound.

29. The invention as set forth in claim 28 wherein the invention further includes:

a binder cutter located downstream from the stitch forming mechanism for severing the stitched binder material tape that connects a garment being stitched to the previous stitched garment, said binder cutter being capable of being actuated in response to a signal from said control system.

30. The invention as set forth in claim 29 wherein the invention further includes:

a first sensor arranged to detecting the leading edge of the garment and transmit this data to the control system, said control system transmits a signal to actuate said binder cutter a predetermined stitch count after the leading edge of the garment is sensed to thus sever the garment being stitched from the preceding stitched garment.

31. The invention as set forth in claim 30 wherein the invention further includes:

said control system being programmed to transmit a signal to said stepper motor, in response to detecting the leading edge of the garment, causing the elastic tape feeder to commence feeding elastic tape from said tape guide to said stitch forming mechanism a predetermined stitch count after the leading edge of the garment is sensed, the predetermined stitch count being calculated to cause the leading edge of the elastic tape to trail the leading edge of the garment.

32. The invention as set forth in claim 30 wherein the invention further includes:

a second sensor adapted to detect the trailing edge of the garment being stitched and transmit this data to the control system, said control system being programmed, in response to receiving this data, to transmit a signal to actuate said elastic tape cutter a predetermined stitch count after the trailing edge of the garment is detected, said predetermined stitch count being calculated to cause the severed trailing edge of the elastic tape to lead the trailing edge of the garment.

33. The invention as set forth in claim 32 wherein the invention further includes:

a second sensor adapted to detect the trailing edge of the garment being stitched and transmit this data to the control system, said control system being programmed, in response to receiving this data, to transmit a signal to actuate said elastic tape cutter a predetermined stitch count after the trailing edge of the garment is detected, said predetermined stitch count being calculated to cause the severed trailing edge of the elastic tape to lead the trailing edge of the garment.

* * * * *